US006272692B1

(12) United States Patent
Abraham

(10) Patent No.: US 6,272,692 B1
(45) Date of Patent: Aug. 14, 2001

(54) APPARATUS FOR ENHANCING ABSORPTION AND DISSIPATION OF IMPACT FORCES FOR ALL PROTECTIVE HEADGEAR

(76) Inventor: Carl Joel Abraham, 3 Baker Hill Rd., Great Neck, NY (US) 11023

( * ) Notice: Subject to any disclaimer, the term of this patent is extended or adjusted under 35 U.S.C. 154(b) by 0 days.

(21) Appl. No.: 09/754,472

(22) Filed: Jan. 4, 2001

(51) Int. Cl.[7] ..... A42B 3/00
(52) U.S. Cl. ..... 2/411; 2/425; 2/909
(58) Field of Search ..... 2/411, 410, 412, 2/425, 909, 414

(56) References Cited

U.S. PATENT DOCUMENTS

| | | | |
|---|---|---|---|
| D. 428,535 | | 7/2000 | Ball . |
| D. 433,541 | | 11/2000 | Ball . |
| 1,714,275 | * | 5/1929 | Mullins . |
| 2,296,335 | * | 9/1942 | Brady . |
| 3,174,155 | * | 3/1965 | Pitman . |
| 4,375,108 | | 3/1983 | Gooding . |
| 4,599,752 | * | 7/1986 | Mitchell . |
| 4,937,888 | | 7/1990 | Straus . |
| 5,655,227 | | 8/1997 | Sundberg . |
| 5,713,082 | * | 2/1998 | Bassette et al. . |
| 5,724,681 | * | 3/1998 | Sykes . |
| 5,732,414 | * | 3/1998 | Monica . |

* cited by examiner

*Primary Examiner*—Rodney M. Lindsey

(57) ABSTRACT

An improved protective headgear apparatus for usage in connection with sporting activities, such as football, hockey, cycling, and the like, and other activities requiring the usage of protective head gear. The protective headgear apparatus is specifically designed to improve the absorption and dissipation of primary forces directly into the shell of the helmet. The assembly comprises a plurality of pre-formed protective pads removably affixed to critical areas of the exterior of the helmet shell for the purpose of decreasing trauma and concussion to users thereof. Such critical or vulnerable locations are: (1) each side of the helmet, at the ear and above the ear; (2) the front of the helmet, between and above the eyes; (3) the rear or occipital area; and (4) the crown of the dome. The pre-formed protective pads function to receive primary forces, with the shell receiving secondary forces, the interior padding receiving additional forces, and only the remaining dissipated forces being distributed to the user's head and brain. Such ancillary protective pad members may be designed to release from the shell when the force of a glancing blow is greater than the force of the fastening attachment. Usage of the invention adds minimal weight to the helmet, with no holes or modifications added to the helmet for attachment. The added protective pads further function to protect the shell of the helmet from fractures and cracks. Thus, the invention allows for increased safety and protection in an inexpensive manner, one that can be manufactured and distributed with relative ease.

18 Claims, 2 Drawing Sheets

APPARATUS FOR ENHANCING ABSORPTION AND DISSIPATION OF IMPACT FORCES FOR ALL PROTECTIVE HEADGEAR

BACKGROUND OF THE INVENTION

1. Field of the Invention

The present invention is an improved protective headgear apparatus. More particularly, the present invention is an improved helmet for sporting activities and other activities requiring usage of protective head gear, such as football, hockey, baseball, softball, lacrosse, skiing, horseback riding, climbing, skateboarding, roller skating, cycling, motorcycling, automobile racing, snowmobiling, construction, police usage, firefighting usage, and military usage. The device is specifically designed to improve the absorption and dissipation of primary forces directly into the shell of the helmet. The assembly comprises a plurality of pre-formed protective pads removably affixed to critical areas of the exterior of the helmet shell for the purpose of decreasing trauma and concussion to users thereof.

2. Description of the Prior Art

Numerous innovations for helmet devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 5,713,082, invented by Bassette et al., entitled "Sports Helmet"

The patent to Bassette et al. describes an improved helmet constructed with a rigid shell having a soft outer covering which absorbs impacts and disperses energy thereby protecting the wearer of the helmet, as well as protecting the impacting object. When used for contact sports such as football, this covering is effective in preventing injuries resulting when the helmet is used as a striking object. The covering may be applied in segmented pieces or as a continuous layer around the shell which forms a solid frame-like structure. A face mask can also be covered with soft, durable covering and be mounted in such a manner to allow the covering to act as a shock absorber against sliding of the mask due to external forces.

2. U.S. Pat. No. 5,655,227, invented by Sundberg et al., entitled "Method Of Fitting Shock-Absorbing Padding To A Helmet Shell And A Helmet Provided With Such Padding"

The patent to Sundberg et al. describes a helmet shell, particularly a face mask for ice-hockey goal tenders, which has an impact-absorbing padding adapted to the individual shape of the wearer's head. A padding blank is first cut from a sheet of thermoplastic material of suitable hardness and the blank is heated to a temperature at which it softens so as to become easily shaped. The blank is then placed in the helmet shell and the shell is placed on the head of the intended wearer and pressed down against the head with a force sufficient for the blank to be brought to the shape of the head and of the helmet shell. This force is maintained until the blank cools to a temperature at which the material retains its shape, where after the padding is affixed to the helmet shell with the aid of fasteners applied to the helmet shell and/or the padding.

3. U.S. Pat. No. 4,937,888, invented by Straus, entitled "Helmet Cover"

The patent to Straus describes an apparatus for protecting the wearer of a helmet in the form of an elastomeric cellular helmet cover, encased in an integral shell of like material, that can be attached to the exterior of an unmodified helmet, by means of flexible tabs, to reduce the potential for injury to the wearer. The helmet cover is configured so that it is thicker in the area where impact is customarily greater, and greater resilience is provided at these points. The helmet cover is sufficiently thick at the front to protrude forward at the edge of the helmet and a face guard attaching parts. The wearer is therefore protected and those contacted by the helmet during the game are also protected.

4. U.S. Pat. No. 5,732,414, invented by Monica, entitled "Helmet Having A Readily Removable And Replaceable Protective Layer"

The Monica invention describes a helmet having an inexpensive polymeric protective layer for preventing or minimizing gouges, scuff marks, flares and the like to the exterior surface of the helmet. The protective layer may be a post-production item which may be readily removable and replaceable by an unskilled user. The helmet is preferably used during a sporting event, such as football, since the protective layer is effective during practice, scrimmage or official games to protect the helmet's exterior surface at all times.

5. U.S. Pat. No. 5,724,681, invented by Sykes, entitled "Shock-Absorbing Helmet Cover"

The patent to Sykes describes a protective cover apparatus for a helmet including a helmet shell with a helmet outer surface and a face exposing opening bordered by a helmet male snap fastener half protruding from the helmet outer surface, a helmet anchoring chin strap assembly having a strap extending from the strap assembly, the strap having a strap female snap fastener half which engages the helmet male snap fastener half bordering the face exposing opening includes a shock-absorbing layer having a layer inner surface and a layer outer surface and which extends over the helmet outer surface and over the helmet male snap fastener half; a shock-absorbing layer attachment assembly including an attachment mechanism including a fastener interconnection structure passing through the layer at a location corresponding to and directly over the helmet male snap fastener half, the interconnection structure having a structure inside end to which is affixed a cover female snap fastener half for removably engaging the corresponding helmet male snap fastener half, and the interconnection structure having a structure outside end to which is affixed a cover male snap fastener half to engagingly receive the strap female snap fastener half so that the chin strap assembly may be attached with the cover in place over the helmet.

6. U.S. Pat. No. 4,375,108, invented by Gooding, entitled "Energy-Absorbing Insert For Protective Headgear"

The patent to Gooding describes an ancillary multi-chambered fluid-filled cushion for use as an energy-absorbing insert on the inside of protective headgear of the type having an outer helmet shell and a flexible inner liner. The chambers may be distinct or may be interconnected by means of communicating passages which control the flow of fluid between chambers. The chamber and communicating passages are formed of resilient material bonded together at perimeter flanges which may be engageable with the helmet inner liner so as to hold the cushion in place. The cushion is aligned intermediate the wearer's head and the outer shell, between existing inner liner components, so as to provide partial support of the helmet shell.

7. U.S. Pat. No. Des. 433,541 invented by Ball et al., entitled "Hockey Helmet"

The design patent to Ball et al. depicts the ornamental design for a hockey helmet, as shown and described.

8. U.S. Pat. No. Des. 428,535 invented by Ball et al., entitled "Hockey Helmet"

The design patent to Ball et al. depicts the ornamental design for a hockey helmet, as shown and described.

The aforementioned prior art patents illustrate various sporting helmets, some with similar theories or objectives as the present invention. However, several features and elements distinguish the present invention from the prior art.

For instance, the first-above-listed patent, issued to Bassette, shows a helmet with additional permanent padding along the entire exterior surface, as compared to detachable padding in critical areas only. In addition, the Bassette patent only teaches the usage of sectional-type padding due to the curvature of the helmet and ease of placement of same on such curved surface.

Moreover, the above-referenced patent to Sundberg also discloses a sporting helmet with ancillary padding. However, the Sundberg device is particularly intended as a face mask for hockey goaltenders, and requires a relatively complex fastening means compared to the present invention.

In addition, the above-referenced patent to Straus discloses a helmet with detachable padding, affixed by hook and loop fasteners in the preferred mode. However, such is embodied in a single-piece cap addition, that is specifically "molded to fit over the top part of a helmet" as noted in Straus claim "1" (emphasis added). Additional prior art patents teach the usage of ancillary members that protect the helmet itself from scratches and cracks, as well as ancillary members utilized to decorate or enhance the appearance of the helmet.

In contrast to the above, the present invention is a helmet specifically designed to improve the absorption and dissipation of primary forces directly into the shell. A previously-existing helmet or new helmet is enhanced through the addition of protective pads removably affixed to critical areas of the exterior of the shell, to mitigate the incidence of concussion and severe injury to the user. The pads are located at each side of the helmet, the front, the occipital area; and the crown area or top of the dome. The exterior pads function to receive primary forces, with the shell receiving secondary forces, the interior padding receiving additional forces, and only the remaining dissipated forces being distributed to the user. Moreover, the protective pads release when a glancing blow is greater than the force of the fastening means.

As such, usage of the invention adds minimal weight to the helmet, with no modifications to the helmet necessary. The pads protect the shell of the helmet from fractures, and even protect opposing players or other persons from injury when the same come in contact with the helmet's rigid outer shell. Finally, the invention provides increased protection inexpensively, allowing the same to be manufactured and distributed with relative ease.

SUMMARY OF THE INVENTION

About 300,000 sports-related concussions occur each year, with 100,000 occurring in the sport of American-style football alone. In addition, approximately 900 sports-related traumatic brain-injury deaths occur each year, and the risk of concussion is approximately 4 to 6 times higher in persons who have experienced previous concussions.

To further illustrate the current problem, the incidence of concussion per 100,00 games or practices at the college level, by sport, are as follows: football-27; ice hockey-25; men's soccer-25; women's soccer-24; wrestling-20; women's basketball-15; and men's basketball-12. A significant number of head injuries is added to the above when activities such as roller blading, roller skating and roller hockey, scooters, motorcycling, and boxing are included.

A concussion is a change in mental status caused by a blow to the head. Symptoms include confusion, amnesia, nausea, dizziness, blurred vision, and loss of consciousness. Such is due to the fact that at the moment of injury, the brain becomes chemically imbalanced. The list of athletes who have sustained career-ending concussions spans every major sport and activity. Although football and hockey are widely considered the most inherently dangerous, no sporting activity is completely safe.

Furthermore, younger athletes are at considerable risk as well. Although the level of play and corresponding collisions are less than those in adult sports, younger players are far less adept at protecting themselves, leading to multiple sever injuries. For the purposes of example, 46% of injuries among children and adolescents in the sport of ice hockey relate to head injuries in particular.

Based upon all of the foregoing, a need exists for protective headgear that will mitigate the incidence of head trauma and concussion. So as to render the same available to the most athletes possible, a need exists for such an apparatus to be manufactured at a relatively low cost. Furthermore, there is a need for such improved headgear to be adapted to helmets of all major sports and recreational activities, as well as additional activities requiring the usage of protective head gear such as construction helmets, hard hats, police and military head gear, and other fields and applications.

As noted herein, past attempts to improve helmet designs to accomplish the desired objectives have largely involved varying the shape or configuration of the hard shell or modifying the type of interior padding utilized by the same. However, such have not effectively shown a decrease in the incidence of concussion and trauma, but have instead added to overall production costs.

As noted above, then, the present invention is an improved protective helmet. More particularly, the present invention is an improved helmet for sporting activities, such as football, hockey, cycling, and the like, and for construction helmets, hard hats, police and firefighter head gear, and military head gear, that is specifically designed to improve the absorption and dissipation of primary forces directly into the shell of the helmet.

In the preferred mode, a previously existing helmet with a rigid outer shell and interior padding is enhanced through the addition of a plurality of pre-formed protective pad members affixed to the exterior of the shell. Such ancillary pads are removably attached to previously-determined critical areas of the helmet, to mitigate the incidence of concussion and severe injury to the user. Such critical or vulnerable locations are: (1) each side of the helmet, at the ear and above the ear; (2) the front of the helmet, between and above the eyes; (3) the rear or occipital area; and (4) the top or crown of the dome.

Generally, it is a known fact that there are many collisions between player's helmets causing concussive and head injuries to each of the participants. It is claimed that the risk of these injuries will be reduced significantly if the pre-formed protective pads are placed in such crucial areas specified in this present invention.

To provide a further example of the utility of the present invention, in the sport of hockey it is a known fact that the goal tender receives lacerations in their forehead from the continuous impacts from pucks hitting the facemask. The forehead area, in most instances, receives the primary force. The present invention will reduce the risk of injury by placing an above-mentioned pre-formed protective pad just above and between the eyes to the forehead area. The pre-formed protective pad will reduce the risk of lacerations and head injuries to goal tenders in a manner previously unavailable.

The aforementioned pre-formed protective pads may be affixed to the exterior of the shell via VELCRO or the like, and may bear a thickness in the range of one-sixteenth to three-quarter inches. Importantly, the exterior pads function to receive primary forces, with the shell receiving secondary forces, the interior padding receiving additional forces, and only the remaining dissipated forces being distributed to the user's head and brain. Moreover, the ancillary protective pad members may be designed to release from the shell when the force of a glancing blow is greater than the force of the fastening attachment.

As such, usage of the present invention adds minimal weight to the helmet, with no holes or modifications added to the helmet for effective attachment purposes. In addition, the added protective pads of the invention function to protect the shell from fractures or cracks, providing additional benefits to the user. Finally, the invention allows for increased safety and protection in a very inexpensive manner, one that can be manufactured and distributed with relative ease.

In summation, in light of the foregoing, it is an object of the present invention to provide a helmet device that is lightweight and relatively inexpensive to manufacture.

It is a further object of the invention to provide a helmet assembly with pre-formed protective pads that are removable and generally convenient to attach and detach.

It is a further object to provide pre-formed protective pads that may be easily retrofitted to previously-existing helmets, providing the benefits of the present invention to all helmet users.

In addition, it is an object of the present invention to provide pre-formed protective pads that may alternatively be manufactured on new helmets for users who desire the benefits.

It is a further object of the invention to provide a headgear apparatus that serves the secondary purpose of mitigating injury to other persons that come in contact with the helmet during the course of sporting activity and other hazardous activity.

It is a further aim of the invention to provide break-away type pads that conveniently attach to a headgear apparatus without modification to the helmet or shell, thus reducing the cost of manufacture.

It is a further goal of the invention to provide break-away type pads that attach to a headgear apparatus without the usage of solid members, such as metal or plastic fasteners.

In addition, it is an object of the invention to provide break-away type pads that protect the most vulnerable areas of the head, such as the temporal areas, the frontal area, the occipital area, and dome area, functioning to significantly reduce the incidence of concussion to the user, thus prolonging the user's playing career.

It is a further object of the present invention to provide break-away type pads that mitigate the incidence of cracking or fractures to the shell of the helmet.

It is also an object of the invention to provide an assembly of exterior pre-formed protective pads, dispensing with any need to add any interior pads to the standard helmet.

It is a further object of the invention to provide break-away type pads that are manufactured in a variety of previously determined sizes, so as to render the same effective for a host of sporting activities and additional applications where such protection is desired.

Another object of the invention is to provide an assembly wherein any damaged pad member may be quickly replaced, absent the need for complex tools and fasteners.

Finally, it is an object of the invention to provide break-away type pads that are manufactured in a variety of previously determined colors and designs, so as to match the décor of the helmet upon which the same are utilized.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
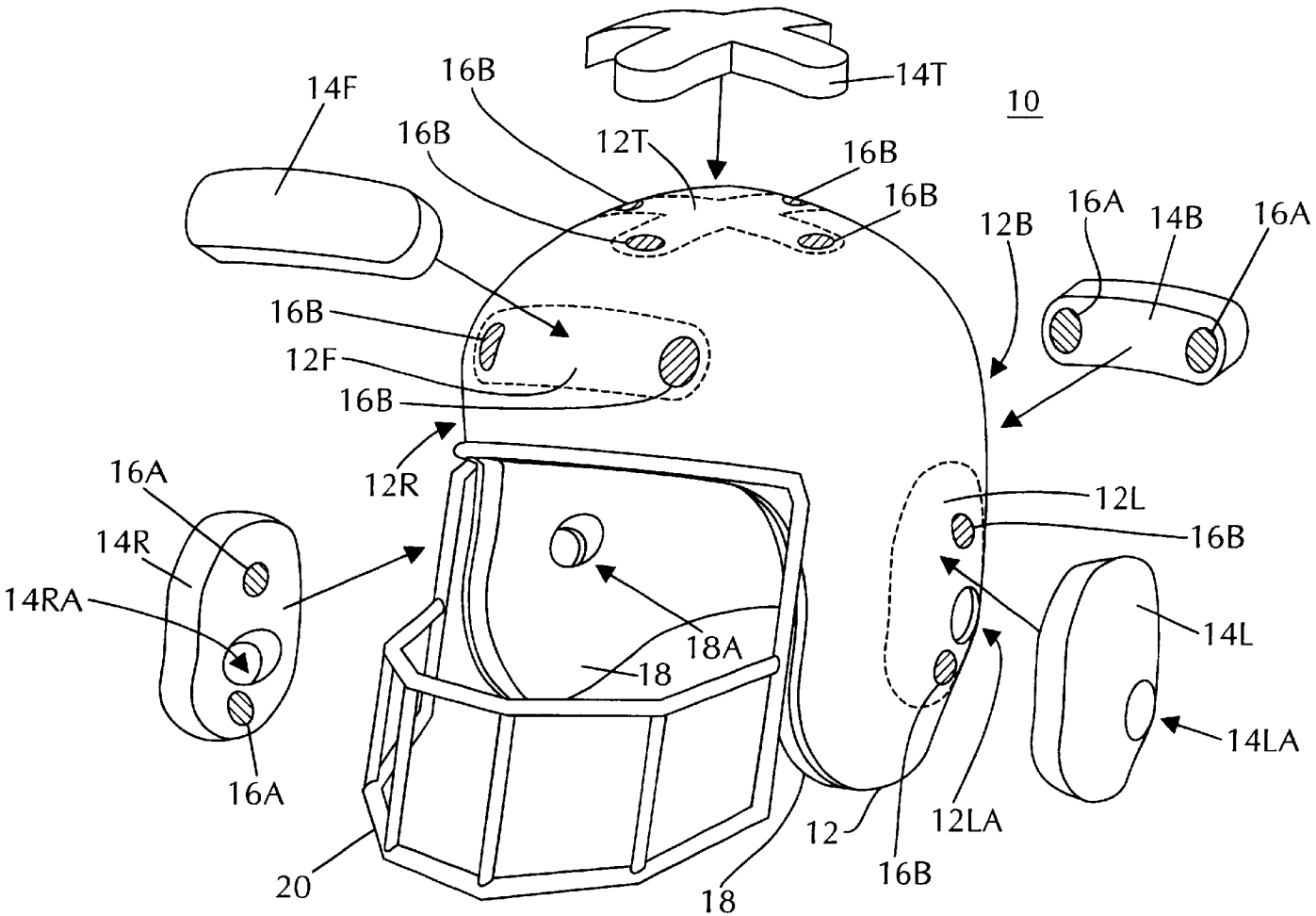
FIG. 1 is a three-quarter front perspective, exploded view of the protective headgear assembly of the present invention, illustrating the principal components and their general location of attachment in the preferred mode.
Figure 2:
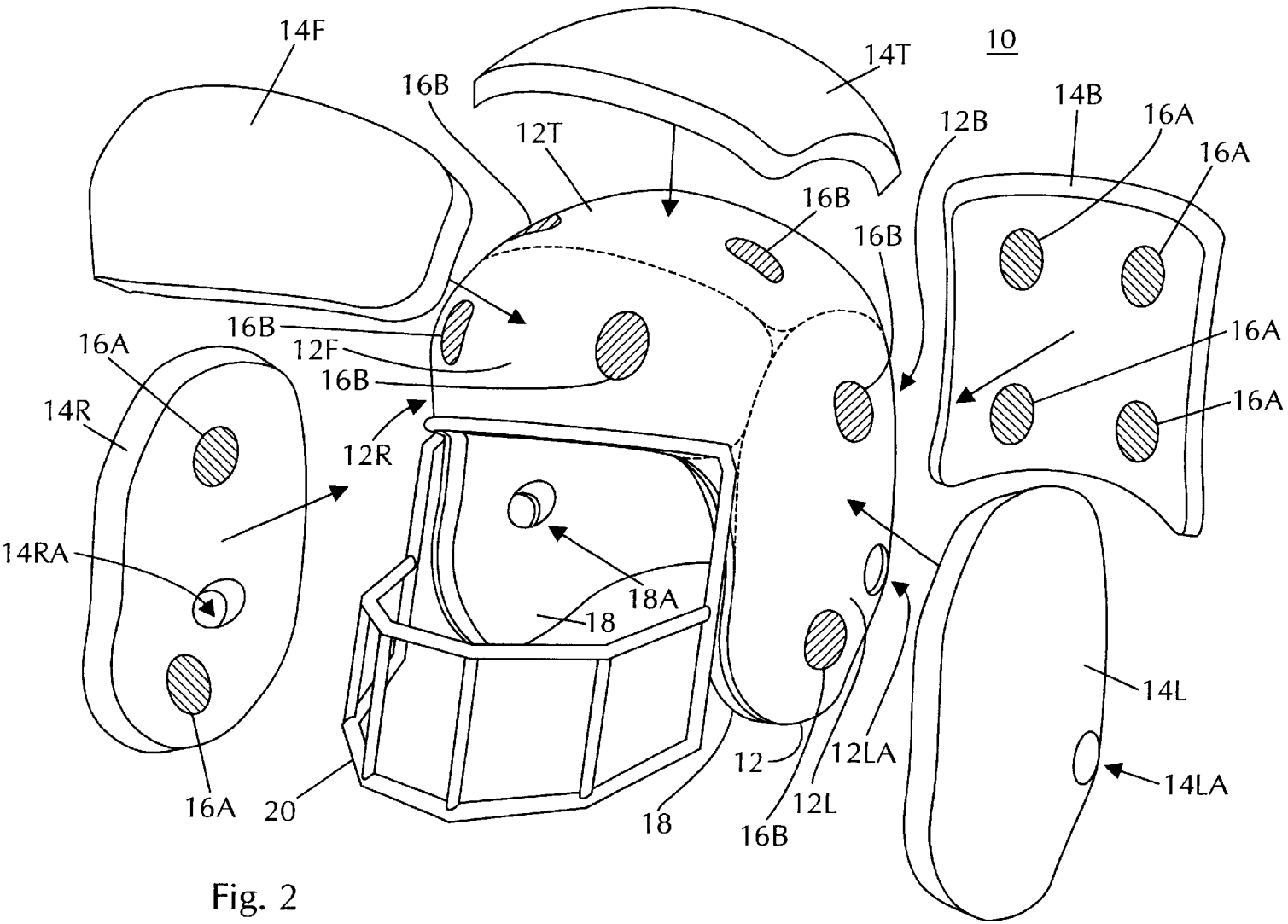
FIG. 2 is a three-quarter front perspective, exploded view of the protective headgear assembly of the present invention, illustrating the principal components and their general location of attachment in an alternate mode, wherein larger protective pad members are utilized to cover a greater portion of the hard shell.

This description relates to the general comments above, as well as FIG. 1, which is a three-quarter front perspective, exploded view of the helmet assembly of the present invention, illustrating the principal components and general location of the attachment in the preferred mode, and FIG. 2, which is a three-quarter front perspective, exploded view of the protective headgear assembly of the present invention, wherein larger protective pad members are utilized to cover a greater portion of the hard shell, if desired by the manufacturer or user.

In both FIGURES, The improved protective headgear apparatus comprises a pre-existing hard shell (12), which comprises a shell left portion (12L), shell right portion (12R), shell front portion (12F), shell back portion (12B), and shell crown portion (12T). The shell is of a traditional shape and configuration for each of a variety of sports or hazardous activities, and requires no modification or alteration.

As such, the shell left portion (12L) further comprises left portion aperture (12LA) generally adjacent to a left ear of a user. Similarly, shell right portion (12R) comprises right portion aperture at a right ear of the user. The pre-existing hard shell (12) further comprises an interior pad (18) rigidly affixed to an interior surface of the hard shell (12), generally along entire periphery thereof. Such interior padding is standard to a host of helmets, and also requires no modification or alteration for implementation of the present invention. To correspond to its hard shell, the interior pad (18) further comprises interior pad apertures generally adjacent to the left ear and right ear of the user.

Importantly, a plurality of pre-formed protective pad members are removably attached to the pre-existing hard shell (12) along the exterior of the shell. To facilitate understanding of the pre-formed pad placement, FIG. 1 depicts multiple dotted lines, demarcating the intended location of the pads in one mode of manufacture. Particularly, in the preferred mode, the plurality of pre-formed pad members comprises a left side pad (14L), right side pad (14R), front pad (14F), back pad (14B), and crown pad (14T). Such pad locations are selected for the purpose of addressing the most critical areas of the head in relation to incidence of trauma and concussion. Specifically, the above-listed pre-formed pad members affix to the hard shell at each temporal area, the frontal area, the rear or occipital area, and the crown or dome of the head. To adapt to the hard shell (12) and interior pad (18), left side pad (14L) further comprises a left side pad aperture 14LA) generally adjacent to a left ear of a user, and right side pad (14R) comprises a right side pad aperture (14RA) at a right ear of the user.

In one mode, each pre-formed protective pad member comprises an attachment means (16A) upon an interior surface thereof, with (16B) illustrating potential receiving members for such attachment means. In the preferred mode of production, the attachment means comprises VELCRO or the like. The attachment means may also consist of hook and loop fasteners, if desired by the manufacturer or user.

Generally, as described in the summary section herein, the pre-formed pad members function to receive primary forces, with the hard shell receiving secondary forces, the hard shell interior padding receiving additional forces, with only remaining dissipated forces distributed to the user. To accomplish this tailored objective, in preferred modes of manufacture the pre-formed pad members are produced in a thickness of a range of one-sixteenth inch to three-quarter inch. However, other thicknesses of pre-formed pads may be utilized if desirable.

In all such cases, the pre-formed protective pads are manufactured in a variety of previously-determined sizes, functioning to render the pre-formed pads effective for multiple previously-determined sporting events and hazardous activities. Thus, the apparatus may be utilized for activities such as football, hockey, baseball, cycling, climbing, skateboarding, roller skating, or any other hazardous activity requiring usage of a protective helmet such as construction, military usage, and police and firefighting usage. Moreover, the pre-formed pads may be manufactured in a variety of previously determined colors and designs. Thus, such will function to match a décor of a helmet upon which the pre-formed pads are utilized, rendering the same even more desirable to the user.

It should further be noted that in one embodiment, the pre-formed protective pads are designed to release from the hard shell when a force of a glancing blow to the apparatus exceeds a force of fastening attachment thereof. Such is an additional benefit to the assembly, as the removed pads may be easily replaced or re-installed at minimal expense.

In all embodiments, as noted, the pre-formed protective pads attach to the hard shell without modification to the hard shell. In fact, it should be noted that the pre-formed pads mitigate the incidence of cracking to the hard shell itself, preserving and prolonging the life of the helmet to the benefit of its owner.

Finally, it bears repeating that the pre-formed protective pads described herein may be retrofitted to previously-existing helmets, or alternatively may be manufactured in connection with new helmets, providing the utmost in versatility to those in need of protective headgear.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. An improved protective headgear apparatus comprising:

a pre-existing hard shell (12), which comprises a shell left portion (12L), shell right portion (12R), shell front portion (12F), shell back portion (12B), and shell crown portion (12T), shell left portion (12L) further comprises left portion aperture (12LA) generally adjacent to a left ear of a user, shell right portion (12R) comprises right portion aperture (12RA) at a right ear of the user, pre-existing hard shell (12) further comprising an interior pad (18) rigidly affixed to an interior surface of the hard shell (12), the interior pad (18) further comprising interior pad apertures generally adjacent to the left ear and right ear of the user; and a plurality of pre-formed protective pad members removably attached to the pre-existing hard shell (12), the plurality of pre-formed pad members comprising a left side pad (14L), right side pad (14R), front pad (14F), back pad (14B), and crown pad (14T), a left side pad (14L) further comprises left side pad aperture (14LA) generally adjacent to a left ear of a user, right side pad (14R) comprises right side pad aperture (14RA) at a right ear of the user, each pre-formed pad member comprising an attachment means (16A) upon an interior surface thereof, the pre-formed pad members functioning to receive primary forces, with the hard shell receiving secondary forces, the hard shell interior padding receiving additional forces, with only remaining dissipated forces distributed to the user's head.

2. The improved protective headgear apparatus as described in claim 1, wherein the apparatus further comprises a face mask removably attached thereto.

3. The improved protective headgear apparatus as described in claim 1, wherein the apparatus further comprises a visor removably attached thereto.

4. The improved protective headgear apparatus as described in claim 1, wherein the apparatus is manufactured in a variety of sizes.

5. The improved protective headgear apparatus as described in claim 1, wherein the attachment means comprises Gore-Tex.

6. The improved protective headgear apparatus as described in claim 1, wherein the attachment means comprises hook and loop fasteners.

7. The improved protective headgear apparatus as described in claim 1, wherein the pre-formed protective pad members are manufactured in a thickness in a range of one-sixteenth inch to three-quarter inch.

8. The improved protective headgear apparatus as described in claim 1, wherein the pre-formed protective pad members are retrofitted to previously-existing helmets.

9. The improved protective headgear apparatus as described in claim 1, wherein the pre-formed pad members are manufactured in connection with new helmets.

10. The improved protective headgear apparatus as described in claim 1, wherein the apparatus is utilized for activities selected from the group consisting of football, hockey, baseball, softball, lacrosse, skiing, horseback riding, climbing, skateboarding, roller skating, cycling, motorcycling, automobile racing, snowmobiling, construction, police usage, firefighting usage, and military usage.

11. The improved protective headgear apparatus as described in claim 1, wherein the pre-formed protective pads are designed to release from the hard shell when a force of a glancing blow to the apparatus exceeds a force of fastening attachment thereof.

12. The improved protective headgear apparatus as described in claim 1, wherein the pre-formed pads attach to the hard shell without modification to the hard shell.

13. The improved protective headgear apparatus as described in claim 1, wherein the pre-formed pads mitigate the incidence of cracking to the hard shell.

14. The improved protective headgear apparatus as described in claim 1, wherein the pre-formed pads are manufactured in a variety of previously determined sizes, functioning to render the pre-formed pads effective for multiple previously determined sporting events and hazardous activities.

15. The improved protective headgear apparatus as described in claim 1, wherein the pre-formed pads are manufactured in a variety of previously determined colors and designs, functioning to match a décor of a helmet upon which the pre-formed pads are utilized.

16. The improved protective headgear apparatus as described in claim 1, wherein the pre-formed protective pads comprise at least one polymer material with retention memory characteristics, functioning to allow the pre-formed protective pads to de-form upon receiving a force thereto and subsequently return to their original structure and thickness.

17. The improved protective headgear apparatus as described in claim 16, wherein the at least one polymer material is selected from the group consisting of polyurethane, a combination of polymers, and a combination of co-polymers.

18. The improved protective headgear apparatus as described in claim 16, wherein the at least one polymer material de-forms in a manner directly proportional to the force received.

* * * * *